US005189780A

United States Patent [19]

Landes

[11] Patent Number: 5,189,780

[45] Date of Patent: Mar. 2, 1993

[54] RIVET SETTING ANVIL

[75] Inventor: Hugh D. Landes, Huron, Ohio

[73] Assignee: Heavy Duty Marketing Corporation, Huron, Ohio

[21] Appl. No.: 911,147

[22] Filed: Jul. 9, 1992

[51] Int. Cl.[5] ..... B23P 11/00; B21J 15/04

[52] U.S. Cl. ..... 29/243.53; 29/243.517; 72/391.2

[58] Field of Search ..... 29/243.53, 243.54, 243.518, 29/243.517; 72/391.2, 453.19

[56] References Cited

U.S. PATENT DOCUMENTS 4,918,798 4/1990 Reed ..... 29/243.53

FOREIGN PATENT DOCUMENTS 0831281 5/1981 U.S.S.R. ..... 29/243.53

2162114 1/1986 United Kingdom ..... 29/243.54

*Primary Examiner*—David Jones

*Attorney, Agent, or Firm*—Pearne, Gordon, McCoy & Granger

[57] ABSTRACT

A rivet setting anvil is provided with a replaceable clinching head that allows the rivet rolling surface to be replaced without replacing the entire anvil. The clinching head may be threaded to the pedestal portion of the anvil or retained with a set screw.

7 Claims, 1 Drawing Sheet

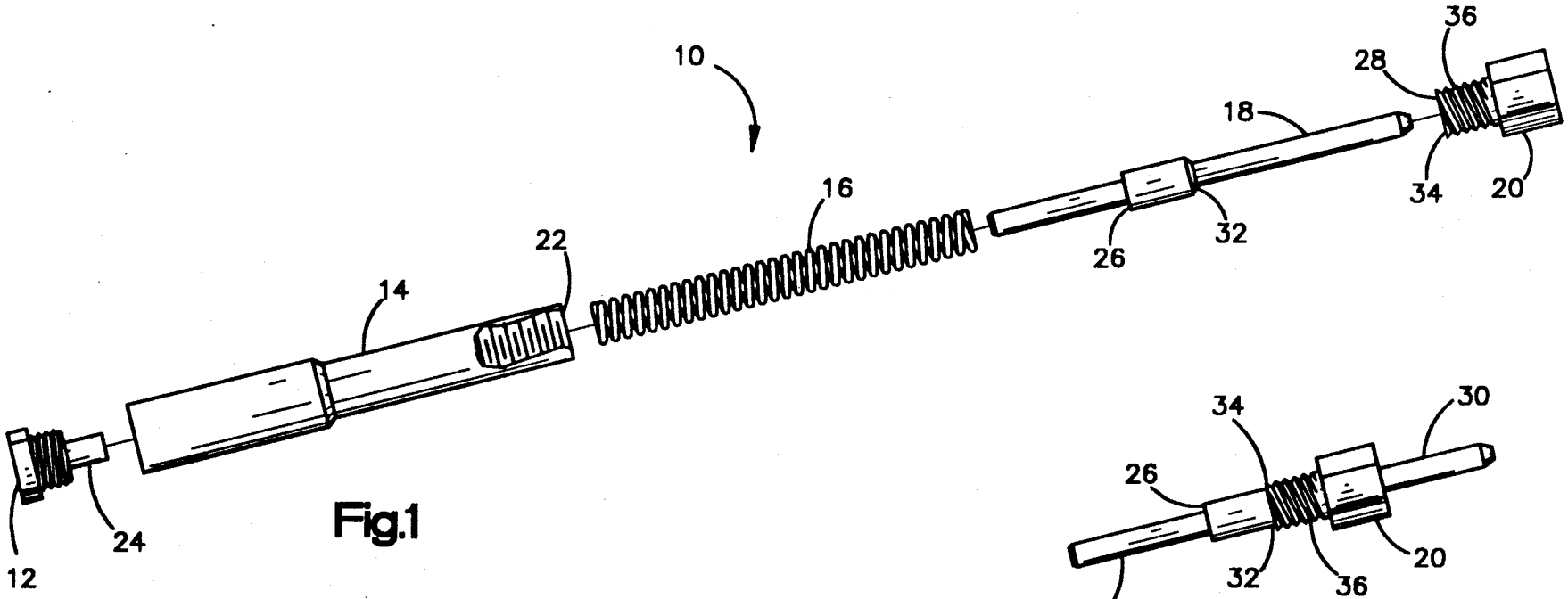
Fig.1
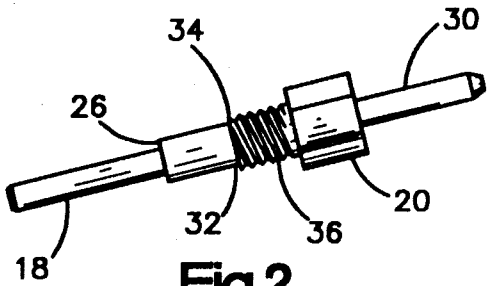
Fig.2
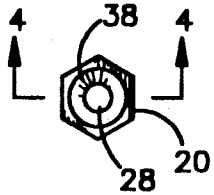
Fig.4
Fig.3

RIVET SETTING ANVIL

BACKGROUND OF THE INVENTION

The present invention relates to riveting apparatus and more particularly to an improved anvil device.

It is known to provide elongate anvils for setting tubular or semi-tubular rivets. The anvils are composed of an elongate hollow cylinder, one end of which is retained in the riveting machine and the other having a rivet clinching or clenching surface.

Typically, a pilot pin or roll pin is located within the cylinder, the end of the pin being extendable through the clinching surface. The pin is spring-loaded to extend from the clinching surface an amount limited by a shoulder on the pin contacting a shoulder within the cylinder.

Tubular or semi-tubular rivets include a relatively large diameter head portion and a reduced diameter tubular or cylindrical portion which is hollow along at least a portion of its longitudinal length to form a rivet bore. The diameter of the rivet bore varies in accordance with rivet size, and a correspondingly sized anvil having a suitably sized pin and clinching surface is required to set or clinch the rivet. For example, truck brake shoe linings are typically assembled with ¼" or 3/16" diameter rivet by various manufacturers. The anvils are elongate to allow the anvil to reach into irregular shaped work pieces such as brake shoes.

The anvil is mounted in a mechanically, pneumatically or hydraulically operated riveting machine for closing movement with a driver head arranged to engage the remote side of the rivet head. The work pieces to be joined are positioned between the anvil and the driver head. The anvil pilot pin extends through a riveting hole in the work pieces to be joined and into the bore the tubular or semi-tubular rivet. As the head of the rivet is driven towards the anvil, the pilot pin guides the rivet through the work piece, retracting as it goes.

As the end of the pilot pin nears the clinching surface, the pin bottoms out and the wall of the rivet starts expanding by being forced over the now stationary pin.

When the wall of the rivet contacts the clinching surface it is rolled radially outward and then back against the work piece. This clinching surface is made up of a cupped annular rivet rolling surface located about the pilot pin. After removal of the work piece, the spring loaded pilot pin again extends in preparation for the next rivet.

The annular rivet rolling surface is critical to the proper clinching of the rivets. To insure proper clinching, the rivet rolling surface is highly polished. If it becomes damaged or worn, rivets may split or fail to clinch properly. This lessens the strength and durability of the riveted connection between the parts and, in some cases, causes failure to meet product specifications. In the latter case, the part must be returned to the manufacturing line for removal of the defective rivet and, in some instances, all other simultaneously made rivet connections, so that the part may be processed once again in the riveting machine. All such corrective processing is costly.

Not only does the rolling surface wear, but many times a piece of foreign matter will damage the rolling surface of a nearly new anvil. In either case, heretofore, the entire anvil had to be replaced.

Heretofore, the anvil cylindrical portion and clinching head were integrally formed to assure stability of the elongate anvil tool and alignment of the pilot pin within the anvil bore and the rivet during the life of the anvil. Such integral or one piece construction was believed necessary to a satisfactory anvil life wherein high riveting loads are intermittently applied and work pieces are aligned for each rivet cycle.

SUMMARY OF THE INVENTION

The rivet setting anvil includes a pedestal having first and second ends, an outside wall and a longitudinal bore. Also included is a clinching head having a clinching portion, an attaching portion and a bore therebetween. The attaching portion is removably attached to the second end of the pedestal and the bores are in communication. The clinching portion has an annular rivet rolling surface located about the head bore. A pilot pin is slidably retained in the bores, a portion of the pin being extensible from the clinching portion. Means are included for urging the pilot pin to extend from the clinching portion.

In the illustrated preferred embodiment, the attaching portion has male threads and the bore of the pedestal has female threads at the second end. The threads cooperate to removably attach the head to the pedestal. A threaded connection between the anvil pedestal and clinching head has been found to provide satisfactory anvil life without loss of pilot pin alignment through the bore. A portion of the threads may be error threads for providing friction to lock the head to the pedestal during use.

The anvil may be provided with contraposed flats to facilitate threading and unthreading the attaching portion to the pedestal.

In the illustrated embodiment, the attaching portion has a shoulder about the head bore and the pin has a shoulder intermediate its length. These shoulders act to limit the extension of the pin from the clinching portion.

The rivet setting anvil of the invention allows for the replacement of the working part, the rivet rolling surface, rather than the entire anvil. The cost of replacing only the clinching portion is a fraction of the cost of an entire prior art anvil.

Because the clinching portion of an anvil (the work area) needs to be made from a highly durable grade tool steel, the entire prior art anvil had to be made of the same steel.

The present invention cost effectively allows the pedestal to be made from less expensive grade tool steel, while the smaller clinching portion can be made of higher quality, more durable tool steel. This economically increases the lifetime of the working surface.

In accordance with the invention, the clinching head and pilot pin may be changed to accommodate different rivet sizes. As noted above, truck brake shoe linings typically employ ¼" or 3/16" rivet sizes. Accordingly, a single set of rivet anvils may be assembled with differently sized sets of clinching heads and pins without removing the anvils from the riveting machine to enable different rivet sizes to be processed. The use of one anvil pedestal to accommodate several different rivet sizes provides an economic savings over prior art anvils which had to be changed in-total to accommodate different rivet sizes.

BRIEF DESCRIPTION OF THE DRAWINGS

FIG. 1 is an exploded perspective view of a rivet setting anvil according to the invention;

FIG. 2 is a perspective view of an assembled portion of the anvil of FIG. 1;

FIG. 3 is a top plan view of the clinching head of the anvil of FIG. 1; and

FIG. 4 is a cross sectional view along the line 4—4 of FIG. 3.

DESCRIPTION OF THE PREFERRED EMBODIMENTS

Referring to FIGS. 1 and 2, a rivet setting anvil 10, is assembled from a threaded end plug 12, a hollow pedestal 14, a spring 16, a pilot pin 18, and a clinching head 20.

The plug 12 is threaded into the open bottom of the pedestal 14 which has mating threads. The spring 16 is inserted into a longitudinally extending bore 22 of the pedestal 14 from the end of the pedestal opposite the plug 12. The bottom end of the spring 16 seats against the plug 12 and surrounds a pin 24 that extends from the plug 12.

The pilot pin 18 is inserted into the bore 22 as well as into the inside of the spring 16. The end of the spring 16 bears against the shoulder 26 on the pilot pin 18, forcing the spring 16 to be compressed as the pilot pin 18 is inserted.

The pilot pin 18 is also inserted into the bore 28 of the clinching head 20, a portion 30 of the pilot pin 18 extending through and beyond the clinching head 20. The portion 30 is limited by contact of a shoulder 32 on the pilot pin 18 with an internal shoulder 34 on the clinching head 20.

The clinching head 20 has a male threaded attaching portion 36 which mates with female threads within the bore 22 of the pedestal 14.

When the plug 12 and the clinching head 20 are threaded into the pedestal 14 the pilot pin 18 is urged by the spring 16 to extend portion 30 from the clinching head 20.

The extent to which the pilot pin 18 may be forced into the bore 22 of the pedestal 14 is limited by contact between the pin 18 and the pin 24.

Referring to FIGS. 3 and 4, an annular rivet rolling surface 38 is provided at the end of the clinching head 20.

The surface 38 is critical to the proper clinching of a rivet. To minimize wear and damage to the surface 38, the clinching head 20 may be formed from a material more wear resistant than that of the pedestal 14, for example, S-7 tool steel.

The shoulders 32, 34 are another location of significant wear in the anvil 10. The invention also allows the wear surface of the shoulder 34 to be replaced without replacing the entire anvil 10. It should also be noted that the shoulder 34 also benefits from the clinching head 20 being made from a higher grade material.

To aid in preventing the clinching head 20 from vibrating loose from the pedestal 14, the threaded attaching portion 36 (and/or its mate in bore 22) may be provided with one or more error threads, that is, threads at a slightly different pitch (not readily visible) than the others (e.g. 19 threads to the inch instead of 20). The error threads increase the friction between the pedestal 14 and the clinching head 20 to prevent inadvertent loosening. Other thread locking techniques may be used to assure maintenance of tightly threaded engagement.

In addition, ease of replacement of the clinching head 20 can be enhanced by providing the head 20 and/or the pedestal 14 with pairs of flats on opposite sides. An example of this is the hexagonal shape of the clinching head 20 as shown in FIG. 3. These flats allow a tool such as a wrench to readily engage the parts of the anvil 10 for assembly/disassembly.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A rivet setting anvil comprising: a pedestal having first and second ends, an outside wall and a longitudinal bore;

a clinching head having a clinching portion, an attaching portion and a bore therebetween, said attaching portion being removably attached to said second end and said bores being in communication, said clinching portion having an annular rivet rolling surface located about said head bore;

a pilot pin slidably retained in said bores, a portion of said pin being extensible from said clinching portion; and means for urging said pilot pin to extend from said clinching portion.

2. An anvil according to claim 1, wherein said attaching portion has male threads and the bore of said pedestal has female threads at the second end, said threads cooperating to removably attach said head to said pedestal.

3. An anvil according to claim 2, wherein at least one of said male and female threads are error threads for providing friction to lock said head to said pedestal during use.

4. An anvil according to claim 2, wherein at least one of said wall and said head have at least two contraposed flats to facilitate threading and unthreading said attaching portion to said pedestal.

5. An anvil according to claim 1, further comprising a threaded plug, said plug plugging the bore of said pedestal at the first end.

6. An anvil according to claim 1, wherein said attaching portion has a shoulder about said head bore and said pin has a shoulder intermediate its length, said shoulders acting to limit the extension of said pin from said clinching portion.

7. An anvil according to claim 1, wherein said clinching portion is made of a longer wearing material than said pedestal.

* * * * *